US006324999B1

(12) United States Patent
Maejima

(10) Patent No.: US 6,324,999 B1
(45) Date of Patent: Dec. 4, 2001

(54) INCINERATOR FOR REMOVING NOXIOUS SUBSTANCES

(75) Inventor: Takashi Maejima, Ishioka (JP)

(73) Assignee: Fumio Maejima, Niiharu-gun (JP)

( * ) Notice: Subject to any disclaimer, the term of this patent is extended or adjusted under 35 U.S.C. 154(b) by 0 days.

(21) Appl. No.: 09/509,941

(22) PCT Filed: Sep. 7, 1998

(86) PCT No.: PCT/JP98/03998

§ 371 Date: Jun. 28, 2000

§ 102(e) Date: Jun. 28, 2000

(87) PCT Pub. No.: WO00/14450

PCT Pub. Date: Mar. 16, 2000

(30) Foreign Application Priority Data

Sep. 4, 1998 (JP) ..... 10-250518

(51) Int. Cl.[7] ..... F23G 7/06; F23G 5/04

(52) U.S. Cl. ..... 110/225; 110/224; 110/208; 110/210; 110/211; 110/219; 110/345; 110/248

(58) Field of Search ..... 110/202, 208, 110/209, 210, 211, 219, 224, 225, 229, 231, 248, 295, 342, 345

(56) References Cited

U.S. PATENT DOCUMENTS 136,418 * 3/1873 Connelly ..... 126/242
1,044,559 * 11/1912 Moor ..... 110/295
3,068,812 * 12/1962 Hemeon ..... 110/8
3,259,083 * 7/1966 Evans ..... 110/8
3,780,674 * 12/1973 Liu ..... 110/8 R
3,808,986 * 5/1974 Logdon ..... 110/8 R
3,981,292 * 9/1976 Lilly et al. ..... 126/121
4,063,521 * 12/1977 Pech ..... 110/8
4,156,394 * 5/1979 Mallek ..... 110/346
4,356,778 * 11/1982 McRee ..... 110/244
4,516,510 * 5/1985 Basic ..... 110/346
4,848,249 * 7/1989 Lepori ..... 112/234
5,107,777 * 4/1992 Mullen ..... 110/346
5,441,714 * 8/1995 Oakes ..... 423/235
5,913,273 * 6/1999 Maejima ..... 110/248

* cited by examiner

*Primary Examiner*—Pamela Wilson
*Assistant Examiner*—Kenneth B. Rinehart
(74) *Attorney, Agent, or Firm*—Armstrong, Westerman, Hattori, McLeland & Naughton, LLP

(57) ABSTRACT

The present invention provides an incinerator for removing toxic substances contained in a flue gas. That is, there is here disclosed an incinerator for removing toxic substances in which a removal section for removing the toxic substances generated from a burning section is connected to the burning section for burning incineration substances, and an air flow of from the burning section to the removal section is prepared by a suction type negative pressure means or by an air duct type negative pressure means, so that a negative pressure condition is always maintained in the burning section.

6 Claims, 18 Drawing Sheets

Temperature data of combustion test

Fig.7

| | Component to be determined | Found concentration (Cs) | Calculated concentration (C) | | Corresponding toxicity concentration |
|---|---|---|---|---|---|
| Dioxin | 2, 3, 7, 8-$T_4$CDD | 0.015 | 0.031 | ×1.0 | 0.031 |
| | $T_4$CDDs | 0.24 | 0.52 | | ····· |
| | 1, 2, 3, 7, 8-$P_5$CDD | ND | 0 | ×0.5 | 0 |
| | $P_5$CDDs | ND | 0 | | ····· |
| | 1, 2, 3, 4, 7, 8-$H_6$CDD | ND | 0 | ×0.1 | 0 |
| | 1, 2, 3, 6, 7, 8-$H_6$CDD | ND | 0 | ×0.1 | 0 |
| | 1, 2, 3, 7, 8, 9-$H_6$CDD | ND | 0 | ×0.1 | 0 |
| | $H_6$CDDs | ND | 0 | | ····· |
| | 1, 2, 3, 4, 6, 7, 8-$H_7$CDD | ND | 0 | ×0.01 | 0 |
| | $H_7$CDDs | ND | 0 | | ····· |
| | $O_8$CDDs | ND | 0 | ×0.001 | 0 |
| | Total PCDDs | 0.24 | 0.52 | | 0.031 |
| Dibenzofuran | 2, 3, 7, 8-$T_4$CDF | 0.055 | 0.12 | ×0.1 | 0.012 |
| | $T_4$CDFs | 0.93 | 2.0 | | ····· |
| | 1, 2, 3, 7, 8-$P_5$CDF | 0.03 | 0.07 | ×0.05 | 0.0035 |
| | 2, 3, 4, 7, 8-$P_5$CDF | 0.03 | 0.05 | ×0.5 | 0.025 |
| | $P_5$CDFs | 0.43 | 0.92 | | ····· |
| | 1, 2, 3, 4, 7, 8-$H_6$CDF | ND | 0 | ×0.1 | 0 |
| | 1, 2, 3, 6, 7, 8-$H_6$CDF | ND | 0 | ×0.1 | 0 |
| | 1, 2, 3, 7, 8, 9-$H_6$CDF | ND | 0 | ×0.1 | 0 |
| | 2, 3, 4, 6, 7, 8-$H_6$CDF | ND | 0 | ×0.1 | 0 |
| | $H_6$CDFs | ND | 0 | | ····· |
| | 1, 2, 3, 4, 6, 7, 8-$H_7$CDF | ND | 0 | ×0.01 | 0 |
| | 1, 2, 3, 4, 7, 8, 9-$H_7$CDF | ND | 0 | ×0.01 | 0 |
| | $H_7$CDFs | ND | 0 | | ····· |
| | $O_8$CDFs | ND | 0 | ×0.001 | 0 |
| | Total PCDFs | 1.4 | 3.0 | | 0.041 |
| | Total PCDDs + PCDFs | 1.6 | 3.5 | | 0.072 |

1. Found concentration : Dioxin and dibenzofuran concentration ($ng/m^3N$)
2. Calculated concentration : Dioxin and dibenzofuran concentration ($ng/m^3N$ at $O_2$ = 12%)

$$C = (21-12) / (21-Os) \times Cs \quad (Os = 16.8\%)$$

3. Corresponding toxicity concentration : 2, 3, 7, 8, -$T_4$CDD corresponding toxicity concentration ($ng\text{-}TEQ/m^3N$)
4. Corresponding toxicity conversion coefficient : to dioxins, International-TEF was applied.
5. "ND" represents "less than the lower of the determinetion.
   The lower limit of the determination. : 4, 5-chloride 0.008 ($ng/m^3N$)
   6, 7-chloride 0.02 ($ng/m^3N$)
   8-chloride 0.04 ($ng/m^3N$)

INCINERATOR FOR REMOVING NOXIOUS SUBSTANCES

TECHNICAL FIELD

The present invention relates to the improvement of an incinerator for removing toxic substances contained in a flue gas.

BACKGROUND ART

In a conventional incinerator, incineration substances have been ignited with a burner in the incinerator and have been burnt with a great deal of air fed to the incinerator. Also, in the conventional incinerator, the amount of incineration substances fed is equal to the amount of air fed for combustion to the incinerator.

However, even though the incineration substances are ignited and burnt in the incinerator, the air does not fully flow throughout the incinerator. Moreover, whenever the incineration substances are fed, the burning temperature in the incinerator lowers, and therefore, the incineration substances are liable to be incompletely combusted. For that reason, there was a disadvantage in that a great deal of carbon monoxide, dioxin and other toxic substances are generated and discharged to the atmosphere.

Also, because of the method of forcibly feeding the air into the incinerator and burning the incineration substances in the incinerator, there was a disadvantage that pressure build-up in the incinerator can cause a violent combustion and turbulence in part the of the incinerator, scattering soot and smoke to the atmosphere.

Thus, it is a purpose of the present invention to provide an incinerator to remove the toxic substances in the flue gas without discharging toxic substances to the atmosphere.

DISCLOSURE OF THE INVENTION

According to the present invention, there is provided an incinerator for removing toxic substances in which a removal section for removing the toxic substances generated from a burning section is connected to the burning section for burning incineration substances, and air flow from the burning section to the removal section is effected by a suction type negative pressure means or by an air duct type negative pressure means, so that a negative pressure condition is always maintained in the burning section.

BRIEF DESCRIPTION OF THE DRAWINGS

FIG. 7 is a table showing the actual concentration and the concentration equivalent to toxicity of dioxin and dibenzofuran contained in the flue gas of a conventional incinerator which burnt the incineration substances with the incinerator for removing toxic substances according to the present invention.

BEST MODE FOR CARRYING OUT THE INVENTION

Figure 1:
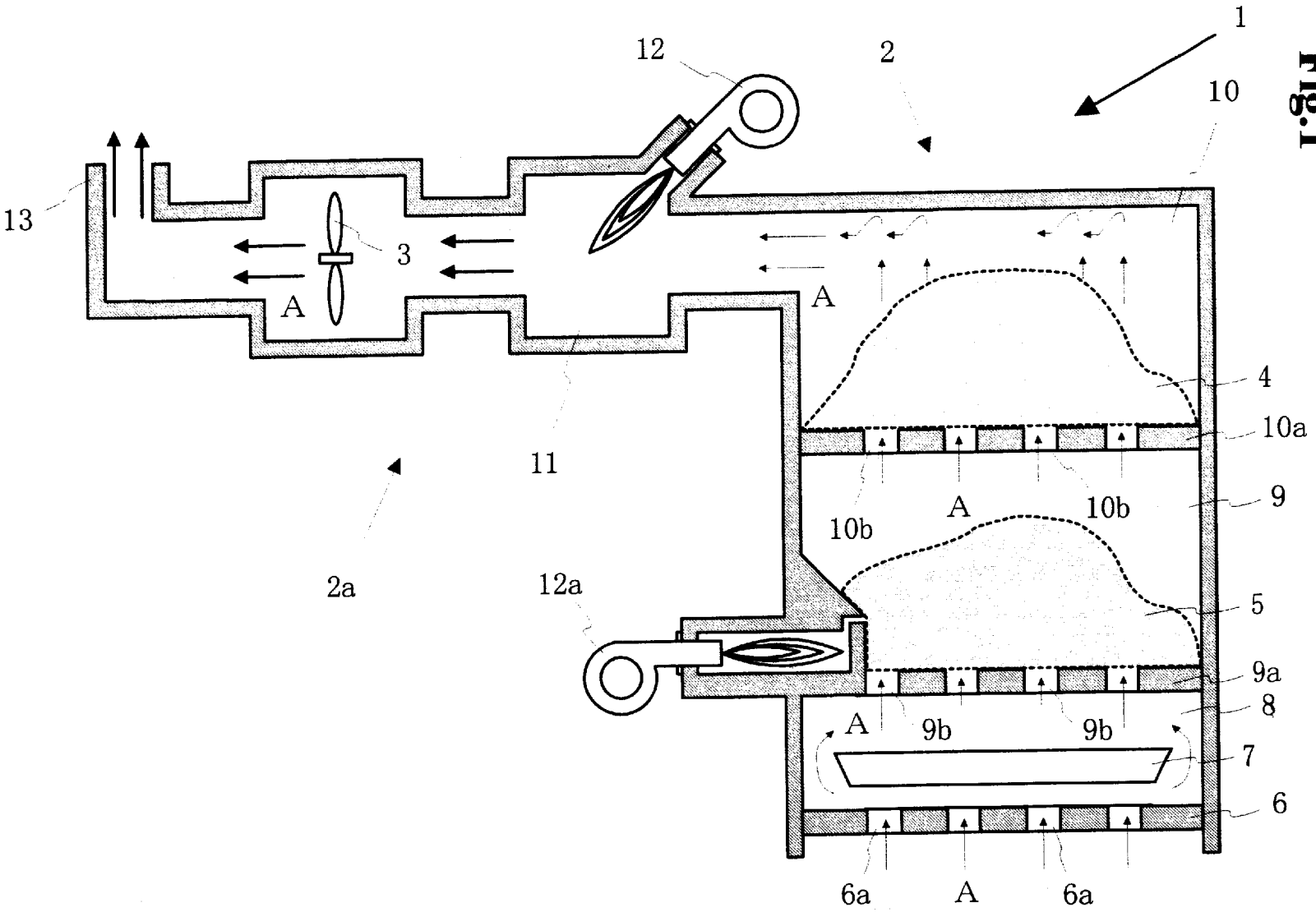
FIG. 1 is a longitudinal sectional view showing an incinerator for removing toxic substances according to the first embodiment of the present invention.

The incinerator for removing the toxic substances according to the present invention is now described in detail with reference to the drawings. FIG. 1 is a longitudinal sectional view showing an incinerator for removing toxic substances according to a first embodiment of the present invention. The incinerator 1 for removing the toxic substances according to the present invention comprises a burning section 2 to burn the incineration substances 5, such as raw refuse 4 and general wastes, and a removal section 2*a* to remove toxic substances.

The burning section 2 of the incinerator for removing toxic substances comprises an ash chamber 8 wherein an ash receiving dish 7 is provided to receive incineration ashes generated after the substances are burnt in a primary combustion chamber 9, the primary combustion chamber 9 having a heating burner 12*a* to burn and incinerate incineration substances 5, and a drying chamber 10 provided on the upper part of the primary combustion chamber 9. FIG. 1 shows the heating burner 12*a*, but such is not limited to the burner, a heater or other heat source means may be used instead.

A partition 10*a* with a number of through holes 10*b*, exists for introducing air between the combustion chamber 9 and the drying chamber 10. Raw refuse 4, containing a great deal of water, is placed on the partition 10*a*.

Heat generated from the combustion of incineration substances 5, passes through holes 10*b*, and a great deal of water contained in the raw refuse 4, placed on the partition 10*a*, evaporates, and thus, the raw refuse is dried. In the burning section 2, a drying chamber may not be used. The partition 10*a* may be of a structure with a dish type partition or a lattice type partition.

In the position near a fire grate 9*a* of primary combustion chamber 9 in the burning section 2, the heating burner 12*a* to ignite and heat the incineration substances 5 before incineration is set up for efficiently burning the incineration substances 5. The heating burner 12*a* may not be a burner, but a heater or other heating means may be used instead.

Beneath the fire grate 9*a*, the ash receiving dish 7, to receive the incineration ash, generated from the combustion of raw refuse 4 and the incineration substances 5, is provided in the ash chamber 8. Because the ash receiving dish 7 is removably provided in the ash chamber 8, the incineration ash accumulated on the ash receiving dish 7 can be removed outside of the incinerator 1 by removal of the ash receiving dish 7.

Instead of the ash receiving dish 7 as a means of removing ash, an oscillating type conveyer belt, rotating type conveyer belt, etc. may be used, or a device to remove ash by a means of suction of the incineration ash may be used.

As shown in FIG. 1, the removal section 2*a* in the incinerator 1 comprises a secondary combustion chamber 11, wherein the heating burner 12 is installed for thoroughly burning unburnt gas exhausted from the combustion chamber 2. A fan 3 provides a constantly negative pressure condition in the ash chamber 8 of the burning section 2, the primary combustion chamber 9 and the drying chamber 10. An exhaust gas outlet 13 is provided to exhaust soot and smoke to the atmosphere which results from the unburnt gas that is thoroughly burnt in the secondary combustion chamber 11. Of course, instead of the heating burner 12, a heater or other heating means may be used.

The means for providing a constantly negative pressure condition in the burning section 2 comprises a suction type negative pressure means for providing a negative pressure condition in the burning section 2, installing the fan 3 in the removal section 2*a*, then inducing the burnt hot air in the burning section 2 by rotating the fan 3 as shown in FIG. 1. The air duct type negative pressure means for providing a constantly negative pressure condition in the burning section 2, sends air forcibly through exhaust gas pipe 3*b* in the secondary combustion chamber 11 by exhausting the air with the smoke in the secondary combustion chamber 11.

In the primary combustion chamber 9 and the drying chamber 10 of the incinerator 2, air induced through a plurality of air inlet holes 6*a*, formed in the floor of incinerator 6 is constantly sent in the direction of the arrow, and the air flows in the fixed direction through air inlet holes 6*a*→the ash chamber 8→the primary combustion chamber 9→the drying chamber 10→the secondary combustion chamber 11→the fan 3→and the exhaust air outlet 13, such that inside of the burning section 2 is kept constantly under negative pressure. The fan 3 is of the suction type negative pressure means, but the air duct type negative pressure means may be applied The volume of air sent through the air inlet holes 6*a* of the floor of incinerator 6 into the ash chamber 8, the primary combustion chamber 9 and the drying chamber 10 can be minutely controlled by adjusting the rotating speed of fan 3. By adjusting the rotating speed of fan 3 in such a way, the volume of air induced into the burning section 2 can be controlled, therefore, the oxygen volume in the burning section 2 can be restricted to the minimum as necessary.

When the raw refuse 4 and the incineration substances 5 fully contained in the burning section are incinerated, the air induced starts burning from the lower part, and thus, the upper part is deprived of oxygen. Also, a great deal of unburnt gas and unburnt carbon are generated, due to the reducing atmosphere. Under the reducing atmosphere, the generation of carbon monoxide and dioxin and other toxic substances can be avoided. When using the reducing atmosphere, that is to say, with an oxygen shortage and at a temperature of 500° C., not less than 300° C., the concentration of dioxin, NOx, SOx, HCL and other toxic substances is low.

When the unburnt gas and unburnt carbon are ignited with the burner 12 in the secondary chamber 11 and the unburnt gas and unburnt carbon, are incinerated at the high temperature of approximately 800° C. or more, then the unburnt gas and unburnt carbon are pyrolyzed and removed without generating carbon monoxide or dioxin, etc., contained in the unburnt gas and unburnt carbon. Also, the toxic substances contained in the flue gas under the reducing atmosphere are completely removed before the exhaust gas outlet 13.

The most favorable temperature for incinerating the toxic substances such as carbon monoxide, dioxin, etc., to remove such substances is approximately 800° C. or more. At such a high temperature the unburnt gas, carbon monoxide, and other toxic substances contained in the flue gas under the reducing atmosphere can be efficiently pyrolyzed and removed.

Figure 2:
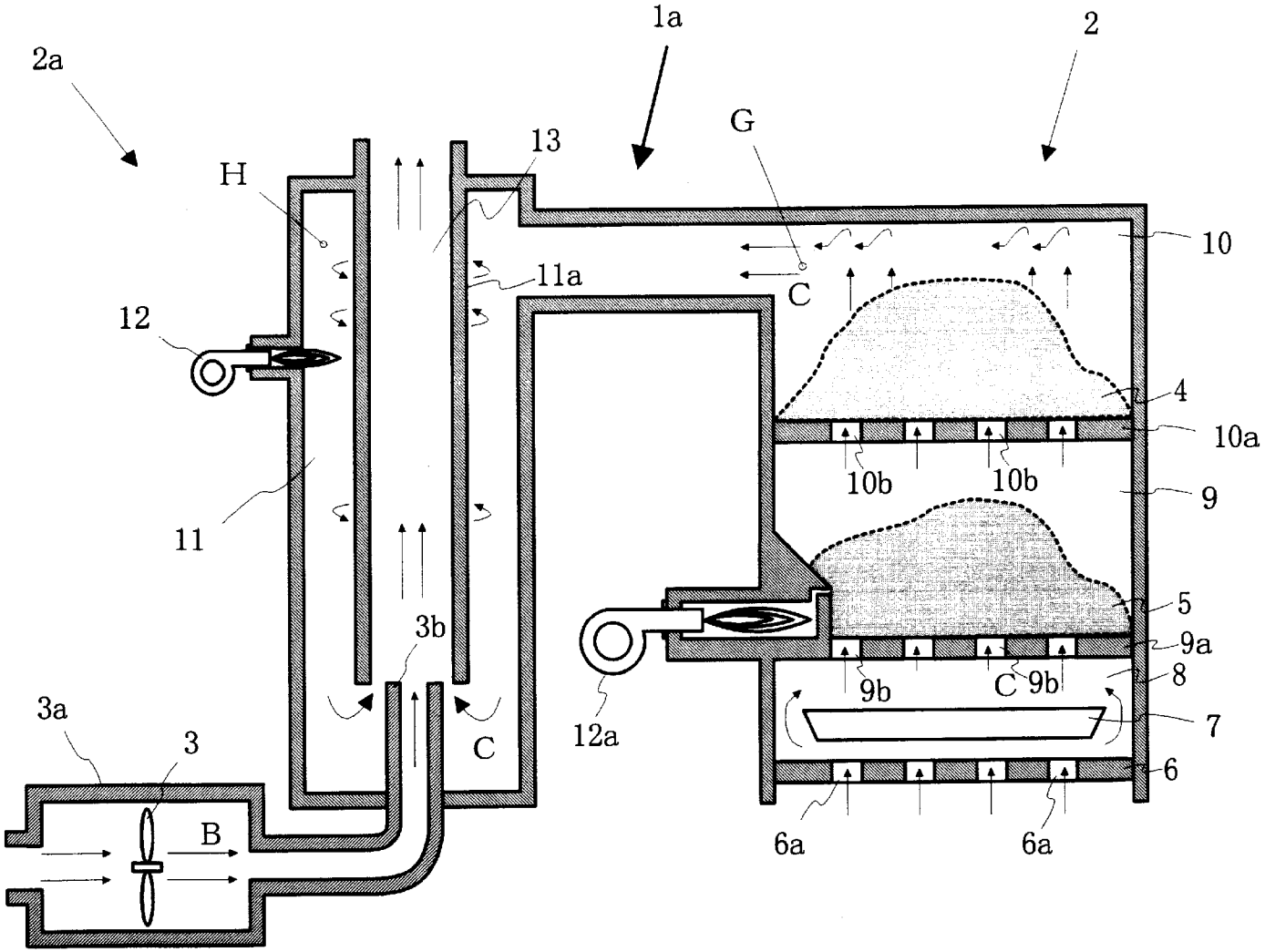
FIG. 2 is a longitudinal sectional view showing an incinerator for removing toxic substances according to the second embodiment of the present invention.

FIG. 2 is a longitudinal sectional view showing an incinerator for removing the toxic substances according to the secondary embodiment of the present invention. In the incinerator 1*a* for removing toxic substances according to this embodiment, the structure of burning section 2 is similar to the structure illustrated in FIG. 1, but the structure of removal section 2*a* is different. Further, in this embodiment, as a means of providing the negative pressure condition in the burning section 2*a*, an air duct type negative pressure means with a blower is employed.

That is to say, the removal section 2*a* comprises an installed exhaust gas pipe 11*a*, the secondary chamber 11 having the burner 12, and a blower 3*a* having an installed fan 3 for blowing air. The removal section is set up in order that the point section 3*b* of the blower 3*a* may be placed in the position adjacent to the bottom of the exhaust gas pipe 11*a*. Or the point section 3*b* may be adjacent to the central position of the bottom of the exhaust gas pipe 11*a*. The burner 12 is never limited to the burner, but a heater or other heating means may be employed.

The fan 3 in the blower 3*a* is driven and rotated, such that outside air is induced into the blower 3*a* in the direction of arrow B. When the induced air is sent into the exhaust gas pipe 11*a* in the secondary combustion chamber 11, the air, followed by the smoke incinerated with the burner 12 of the secondary combustion chamber 11, due to the negative pressure provided is exhausted through the exhaust gas pipe 11*a* in the direction indicated by the arrow C.

In the incinerator for removing the toxic substances 1*a* according to this embodiment, the smoke consisting of unburnt gas, unburnt carbon, etc., containing toxic substances generated in the burning section 2 is sent to the secondary combustion chamber 11 of the removal section 2*a* with the burning section 2 in line and introduced into the exhaust chamber 11*a* with the driving of fan 3. The smoke is burnt under the reducing atmosphere containing unburnt gas and unburnt carbon and other toxic substances in the secondary chamber 11, then the smoke is exhausted from the exhaust gas pipe 11*a* into the atmosphere.

Figure 3:
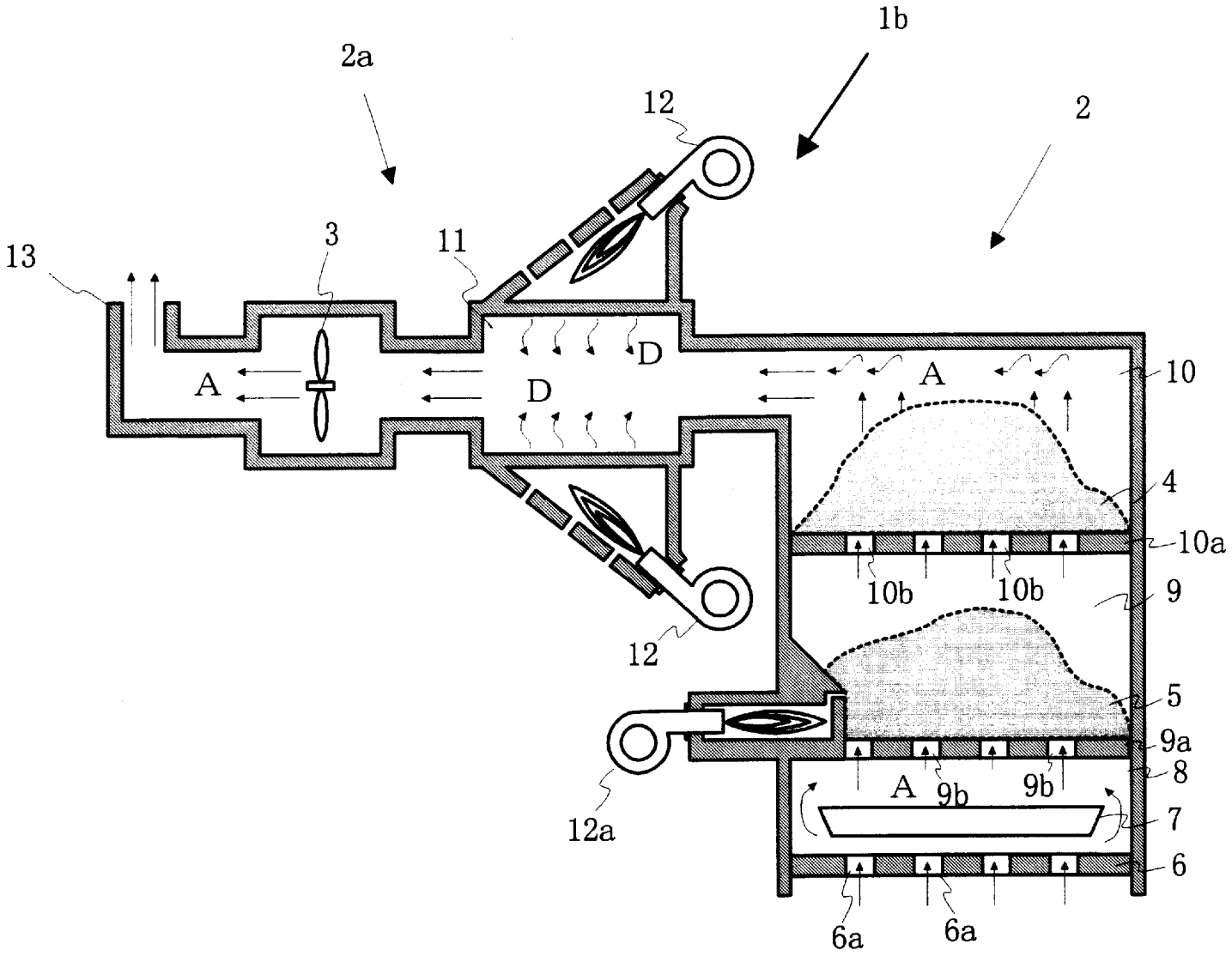
FIG. 3 is a longitudinal sectional view showing an incinerator for removing toxic substances according to the third embodiment of the present invention.

FIG. 3 is a longitudinal sectional view showing an incinerator for removing the toxic substances according to the third embodiment of the present invention. The incinerator for removing the toxic substances according to this embodiment is an incinerator 1*b* for removing the toxic substances having two (2) burners 12, and 12 installed in the secondary combustion chamber 11. By installing two (2) burners 12 in the secondary combustion chamber 11, it is possible to more efficiently incinerate and pyrolyze the toxic substances. D in FIG. 3 shows incineration and pyrolyzing under the reducing atmosphere comprising the unburnt gas and unburnt carbon, etc. containing the toxic substances. In FIG. 3, only two (2) burners are shown installed in the secondary combustion chamber 11, although more than two (2) burners may be installed.

In the incinerator for removing the toxic substances 1*b* according to this embodiment, driving and rotating the fan 3 causes the smoke in the secondary chamber 11 to flow in the direction of the arrow A, and also causes the air in the burning section 2 to flow in the order of the ash chamber 8→the primary combustion chamber 9→the drying chamber 10 and→the secondary combustion chamber 11 because of the suction of smoke in the air with the fan 3. For its reason, the smoke (exhaust gas) containing the toxic substance such as the unburnt gas and unburnt carbon, etc., is induced into the secondary combustion chamber 11 and is exhausted from the exhaust gas outlet 13, after incinerating the toxic substances contained in the smoke with the burners 12. In this embodiment, the suction type negative pressure means is employed.

Figure 4:
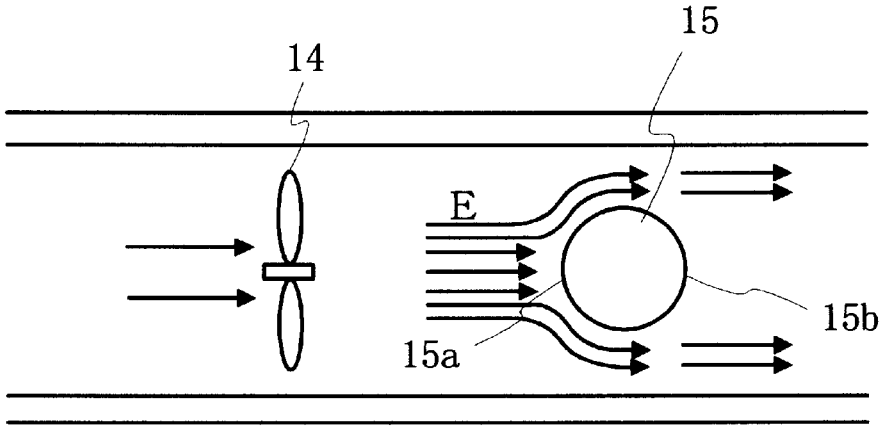
FIG. 4 is a view showing air flow in the conventional incinerator.
Figure 5:
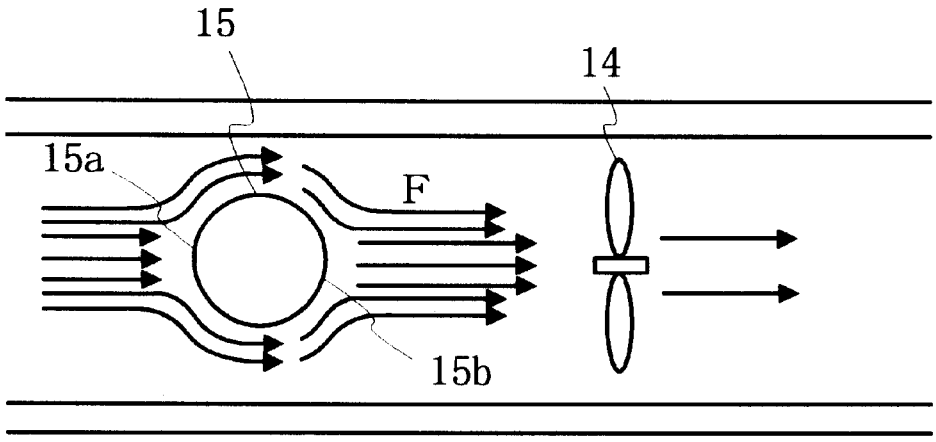
FIG. 5 is a view showing air flow in an incinerator for removing toxic substances according to the present invention.

FIG. 4 and FIG. 5 are views showing how the air flows with the incineration substances in the cases of blowing the air and suction of the air. FIG. 4 is a view showing how the air flows around the incineration substances in the "case of blowing the air" by rotation of the fan 14 and to blow the incineration substances. FIG. 5 is a view showing how the air flows around the incineration substances in the "case of suction of air" by rotation of the fan 14. FIG. 4 is a view showing how the air flows in case of the conventional incinerators, that is to say, a view showing the flowing in the "case of blowing the air," while FIG. 5 is a view showing how the air flows in the "case of suction of air" such as the case of the incinerator for removing the toxic substances according to the present invention.

In FIG. 4 showing how the air flows in the conventional incinerators, blowing the air in the direction toward an object (incineration substance) by means of rotating the fan 14 causes the air to hit the front 15*a* of the object 15 indicated as arrow E, and further causes the air to change from laminar flow to turbulent flow, that is to say, flowing above and underneath the object 15 separately, but no air flows to the back 15*b* of the object (incineration substance).

For this reason, the air hits only the front of the object 15, but does not hit the back 15*b* of the object. Because no new air hits the back of the incineration substances 15, the back portion 15*b* of the incineration substances 15 remains an unburnt portion. Because of pressuring, in the cavities of the incineration substances a pressure loss and unburnt portions remain as the air cannot reach to the deep inner part.

FIG. 5 is a view showing how the air flows around the incinerator in the "case of suction of the air." In the FIG. 5 showing how the air flows in the incinerator for removing the toxic substances 1*b* according to the present invention, the air is induced into the incinerator with rotation of the fan 14 and the induced air flows in the direction of arrow F. At this time, new air hits the front 15*a*, back face 15*b*, upper face and bottom of the incineration substances 15, all around, therefore, the incineration substances 15 are completely burnt. Also, when burning the incineration substances 15 in such condition of absorbing the air, that is to say, by providing negative pressure in the burning section 2, the air flows minutely in the cavities of the incineration substances themselves, which causes complete combustion without leaving unburnt portions in the incineration substances 15.

Figure 6:
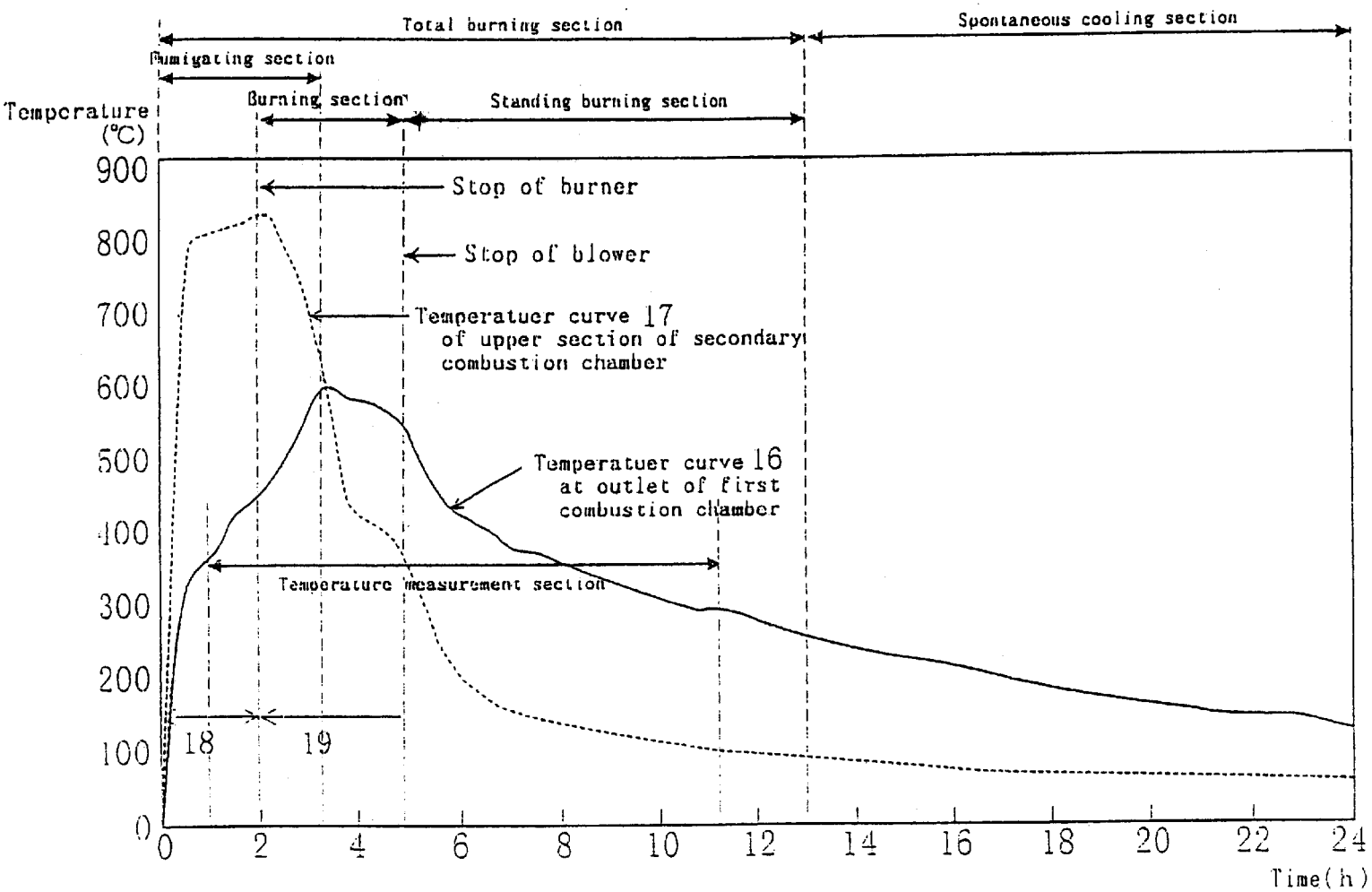
FIG. 6 is a table showing consecutive changes of temperature in the burning section of the incinerator for removing toxic substances according to the present invention.

FIG. 6. is a table showing consecutive changes of temperatures in the burning section of the incinerator for removing the toxic substances according to the present invention. To describe the table by referring to FIG. 2, the temperature curve of the outlet of the primary combustion chamber is measured at G point of FIG. 2, while the temperature curve of the upper section of the secondary combustion chamber is measured at H point in FIG. 2.

During the period 18 while the temperature in the outlet of primary combustion chamber is kept less than 450° C., the toxic substances such as dioxin, etc. are contained in the flue gas without being pyrolyzed, therefore, the ignition of burners 12 in the secondary combustion chamber 11 burns the toxic substances and removes them from the flue gas.

During the period 19 while the temperature in the outlet of the primary combustion chamber is kept at 450° C. or more, the air volume in the primary combustion chamber 9 is restricted to the minimum as necessary. The combustion of the incineration substances in the burning section 2 causes the incineration substances to start burning the induced air volume from the bottom part, and with an oxygen shortage in the upper part, the unburnt gas and unburnt carbon generated in the primary combustion chamber 9 under the reducing atmosphere is burnt in the secondary combustion chamber, so as to restrict the generation of dioxin, carbon monoxide, etc., and further to pyrolyze these toxic substances. The table shows the concentration of dioxin and dibenzofuran contained in the flue gas and the concentration equivalent to toxicity.

As illustrated in FIG. 7, in the incinerators for removing the toxic substances 1, 1*a*, 1*b*, the concentration equivalent to toxicity of dioxin is 0.031 ng/m$^3$, such concentration at the result of measurement is less than 0.1 ng/m$^3$ which is the standard stipulated by the Air Pollution Control Law and Wastes Disposal and Public Cleaning Law revised and enforced as from Dec. 1, 1997. Also, the volume of dibenzofuran exhausted is extremely small.

Figure 8:
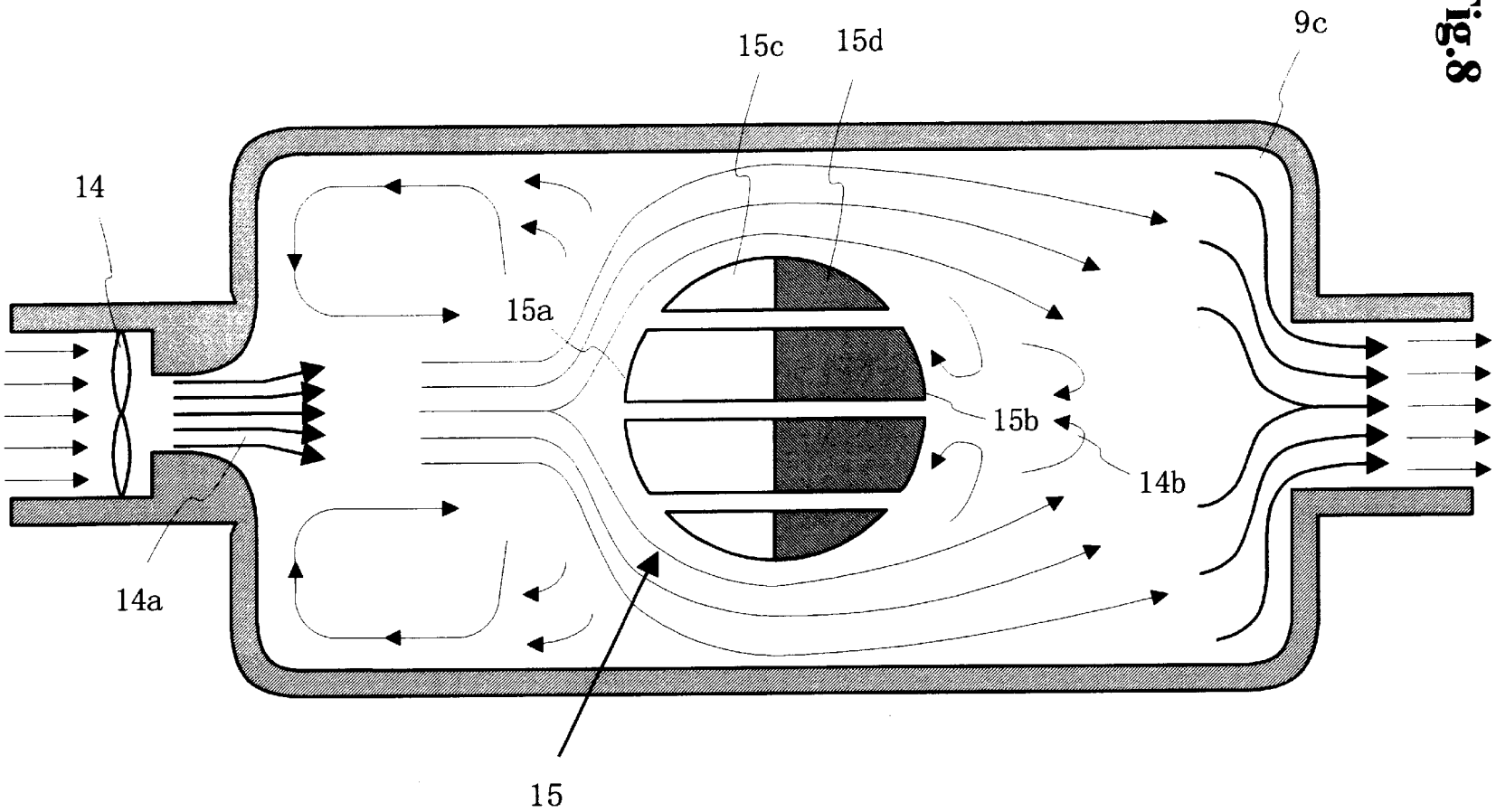
FIG. 8 is a view showing air flow in the conventional incinerator.
Figure 9:
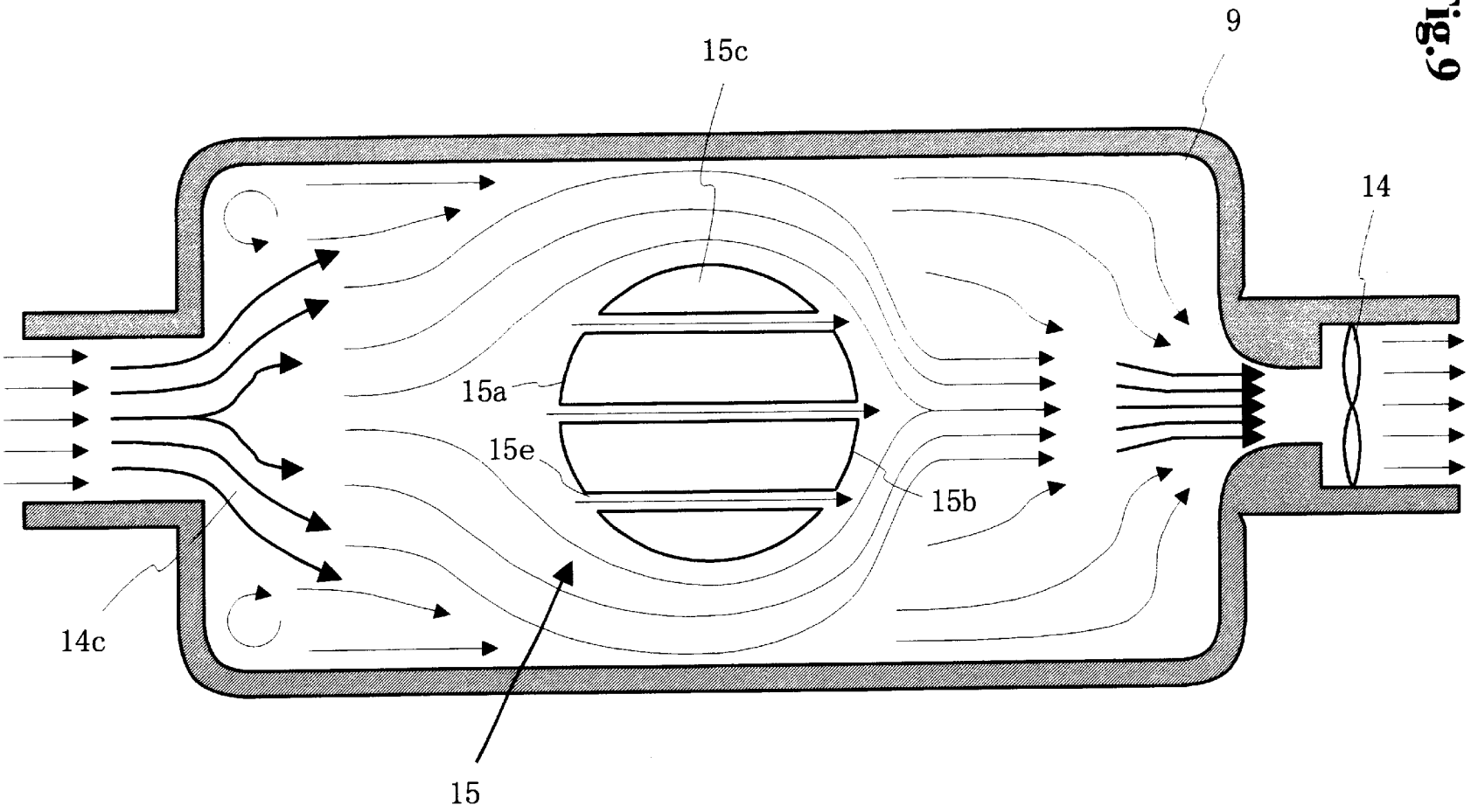
FIG. 9 is a view showing air flow in the incinerator for removing the toxic substances according to the present invention.

FIG. 8 is a view showing how the air flows in a conventional incinerator, that is to say, a view showing the incineration substances in the incinerator of the structure wherein the air is blown and hits the incineration substances, and the air flow in such incinerator. FIG. 9 is a view showing how the air flows in the incinerator for removing the toxic substances according to the present invention, that is to say, a view showing the incineration substances in the incinerator of the structure wherein the air is induced by a negative pressure and hits the incineration substances, and the air flow in such incinerator.

When the incineration substances 15 are burnt by blowing the incineration substances with the conventional blower, the incineration substances 15 in the combustion chamber 9 of the incinerator 2 are burnt, after starting to ignite the crushed incineration substances, by blowing air 14*a* toward the ignition face with the fan 14, directly hitting the incineration substances 15 with the air forcibly, and incomplete burning of the incineration substances 15 results. Only the front face 15*a* of the incineration substances 15, which the air hits directly, is well burnt due to blowing air 14*a* in such a way. Also, with the blowing of air, the burning portion gradually proceeds only a little internally from the front face 15*a* of the incineration substances toward the inside of the incineration substances 15.

However, the portion which the blowing air does not hit, that is to say, the back face 15*b* of the incineration substances 15 lacks oxygen because the air after burning the front face 15*a* of the incineration substances might come to the back face 15*b*. The back face 15*b* of the incineration substances 15 usually generates turbulence 14*b* and the air around it is very thin, moreover, even if there is a burning portion in the back face 15*b* of the incineration substances 15, the air does not flow and prevents burning the inside of the object. Therefore, the burning does not proceed into the inside of the incineration substances 15.

For the above reason, as illustrated in FIG. 8, almost all the incineration substances 15 are never completely burnt, particularly, the unburnt portion 15*d* of the incineration substances 15 largely remains. By the method of the conventional blowing type burning, complete combustion cannot be satisfactorily met.

However, as illustrated in FIG. 9, in the incinerator for removing the toxic substances according to the present invention, to burn the incineration substances 15, the air does not hit the incineration substances 15 directly, but, because of the negative pressure condition in the burning section 2, with the inducing of air into the primary combustion chamber 9 with the fan 14 (the suction type negative pressure means), the air induced does not hit the incineration substances 15 directly, and the air 14*c* flows all around the incineration substances 15 thoroughly.

For the above reason, no turbulence is generated on the back face 15*b* of the incineration substances 15 under the negative pressure condition, the air flows smoothly and thoroughly all around the incineration substances 15, the burnt portion in the front face 15*a* of the incineration substances 15 proceeds to the inside with a little air flowing into the cavities in the inside of the incineration substances 15, proceeding toward and around them to provide complete combustion.

Because of the negative pressure condition in the primary combustion chamber 9, inducing (absorbing) the air through the air intake inlet, the air flows thoroughly not only all around the incineration substances 15 but also through little cavities in the inside of the incineration substances 15, which are burnt to complete combustion and reduced to ashes.

As illustrated in FIG. 9, almost all the incineration substances are completely combusted and reduced to ashes, and are completely burnt until the incineration substances are reduced to ashes. With the method of combustion using the negative pressure condition and with the method of absorbing air according to the present invention, the required conditions of complete combustion, usually known as the condition without generating any toxic substances from the incineration substances 15, can be satisfactorily met.

Used accounting slips, high quality rolls of paper of about 1 m×0.5 m, raw refuse, etc. were densely stuffed in the primary combustion chamber 9 of the incinerator for removing toxic substances according to the present invention without crushing them and a burning experiment was conducted. Almost no smoke was exhausted from the funnel, and the burnt ashes after the burning the incineration substances were perfectly combusted until the ashes became white. Particularly, because the high quality rolls of paper with almost no cavities resulted and were perfectly burnt and reduced to ashes, without any unburnt portion remaining, owing to the air passing into the cavities, it was confirmed with the result of the experiment that the method of burning using negative pressure of the incinerator according to the present invention is far better than the conventional incinerators.

FIG. 10, FIG. 11, FIG. 12, FIG. 13, FIG. 14 and FIG. 15 are views showing burning conditions of the incineration substances in the burning section of the incinerator for removing toxic substances according to the present invention respectively. That is to say, FIG. 10 through FIG. 15 are the views showing the condition of burning of the incineration substances 20 laid in the primary combustion chamber 9 of the incinerators according to the present invention.

The burning section 2 shown in FIG. 10 through FIG. 15 are of the structure without the drying chamber 10, and are of the same structure as the primary combustion chamber 9 of the burning section illustrated in FIG. 1, FIG. 2 and FIG. 3. They are divided into the primary combustion chamber 9 and the ash chamber 8 with the fire grate 9*a* forming the through holes 9*b*. The combustion chamber outlet 9*a* to exhaust the flue gas on the upper end of the primary combustion chamber 9, and the ash receiving dish to accept the incineration ashes generated from the burning of the incineration substances 20 is removably installed in the ash chamber 8 set up between the incinerator floor 6 forming the number of air intake hole 6*a* for inducing the air and the fire grate 9.

In FIG. 10 through FIG. 15, as the structure is described from heating and igniting the incineration substances 15, no indication of the heating burner 12*a*, heater, and other heat sources is shown on the burning section 2 as illustrated in FIG. 11 through FIG. 15.

Figure 10:
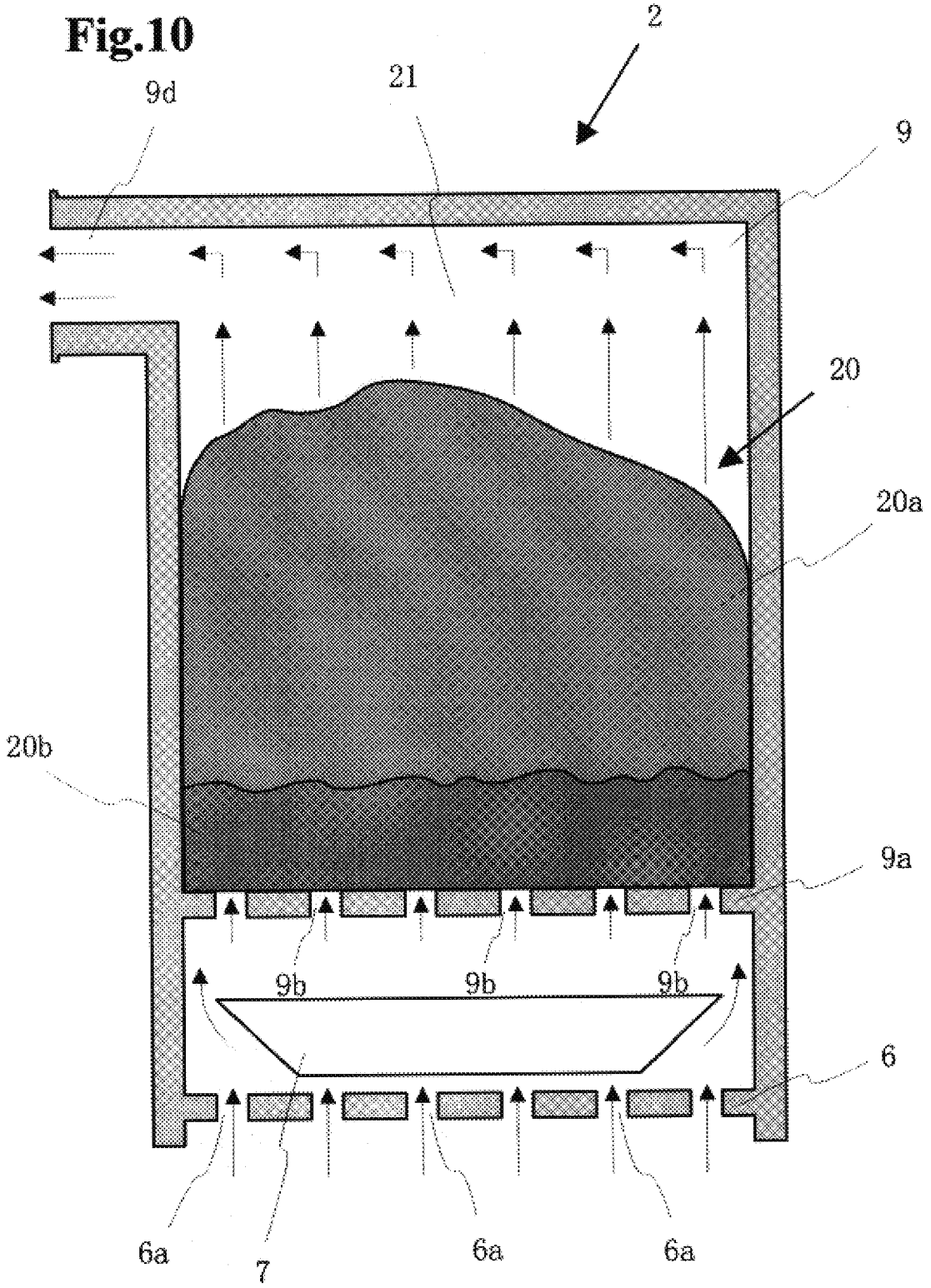
FIG. 10 is a view showing a burning condition of incineration substances in the burning section of the incinerator for removing toxic substances according to the present invention.

Firstly, as shown in FIG. 10, the incineration substances 20 are accumulated in the primary combustion chamber 9, of the burning section 2 according to the present invention, and the bottom section of the incineration substances 20 is ignited. After ignition, the bottom section of the incineration substances 20 are burnt together with oxygen in the air induced from the through holes 9*b* in the oxidizing and burning section 20*b*. The unburnt section 20*a* exists in the entirely unburnt condition on the oxidizing and burning section 20*b*.

The combustion chamber outlet 9*d* on the upper part of the burning section 2 is set up in line with the removal section 2*a* to remove the toxic substances according to the present invention, and with the rotation of fan 3 set up in the removal section 2*a* the air is absorbed and induced into the burning section 2.

The heat in the primary chamber 9 through the air absorb inlet 9*d* causes the inside of the primary combustion chamber 9 to assume a negative pressure and further allows the fresh air to be sucked in through the through holes 9*b*, via the air intake holes 6*a* into the primary combustion chamber 9.

The fresh air is passed to the upper part of the incineration substances 20 through cavities in the oxidizing and burning section 20*b* and unburnt section 20*a* in the incineration substances 20. When the fresh air is passing through the oxidizing and burning section 20*b* underneath the incineration substances 20, the fresh air passing in the incineration substances 20 promotes oxidation and burning, and the fresh air containing the smoke passes to the upper part of the incineration substances 20 through the unburnt section 20*a*.

In the hot air containing the smoke passing to the upper part of the incineration substances 20, carbon monoxide, dioxin and other toxic substances are pyrolyzed under the reducing atmosphere, then a small quantity of them are mixed and contained in it. The hot air containing unburnt gas and unburnt carbon which generates carbon monoxide, dioxin, and other toxic substances is pyrolyzed under the reducing atmosphere 21, and are floating on the upper part of the incineration substances 20, and sent from the air intake inlet 9*c* into the removal section 2*a*.

Figure 11:
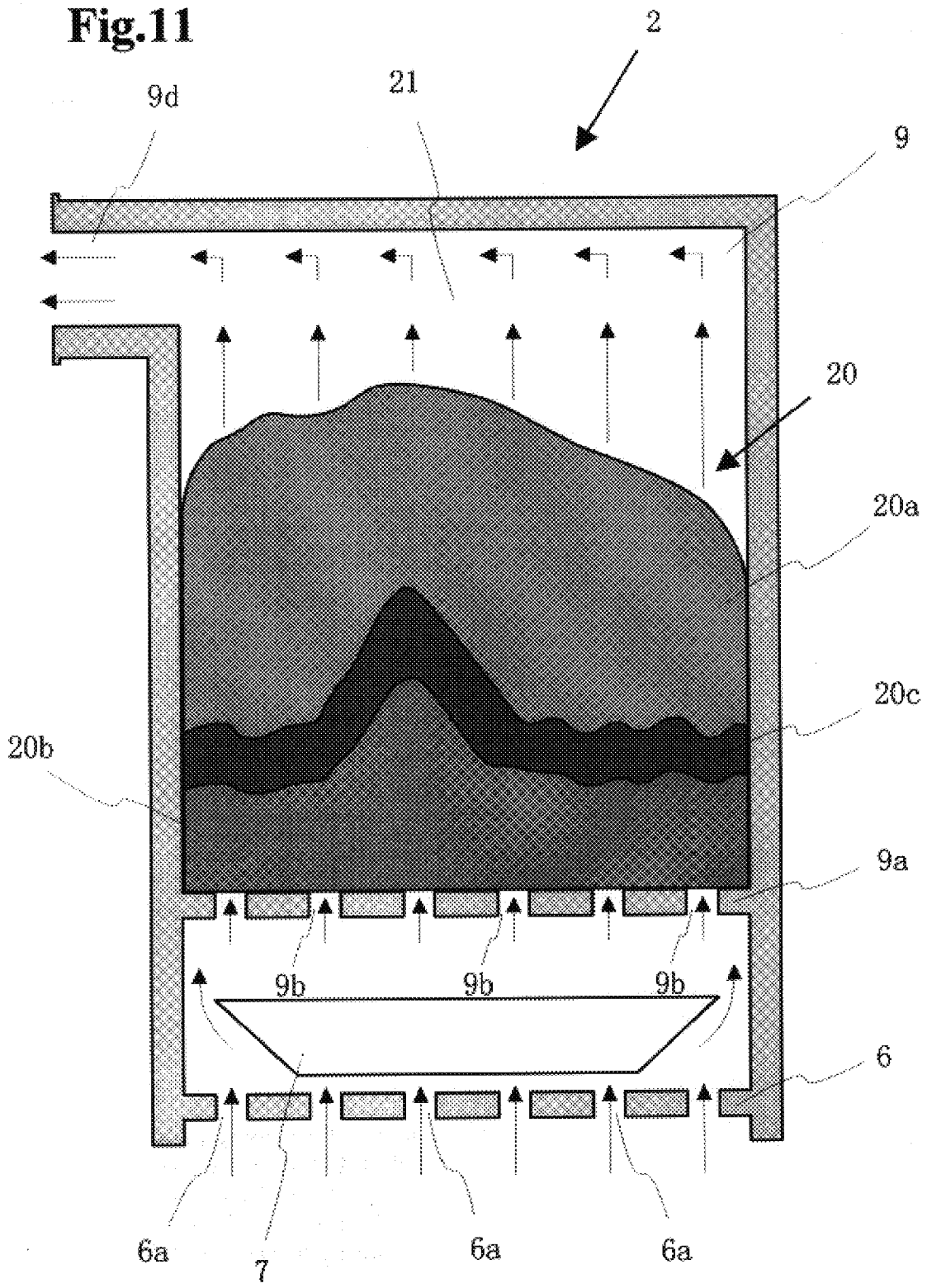
FIG. 11 is a view showing another burning condition of incineration substances in the burning section of the incinerator for removing toxic substances according to the present invention.

Next, as illustrated in FIG. 11, the oxidizing and burning section 20*b* continues burning by supply of fresh air induced from the through holes 9*b*. However, in the unburnt section 20*a* on the oxidizing and burning section 20*b*, oxygen is consumed by passing through the oxidizing and burning section 20*b*, the hot air and reducing atmosphere 21 containing smoke are passing, therefore, a fumigating and burning section 20*c* is gradually formed by the oxygen-depleted air containing the hot air and smoke.

The oxidizing and burning section 20*b* and the fumigating and burning section 20*c* are gradually extended from the lower part to the upper part in the incineration substances 20 with the air passing through the inside of the incineration substances 20.

Figure 12:
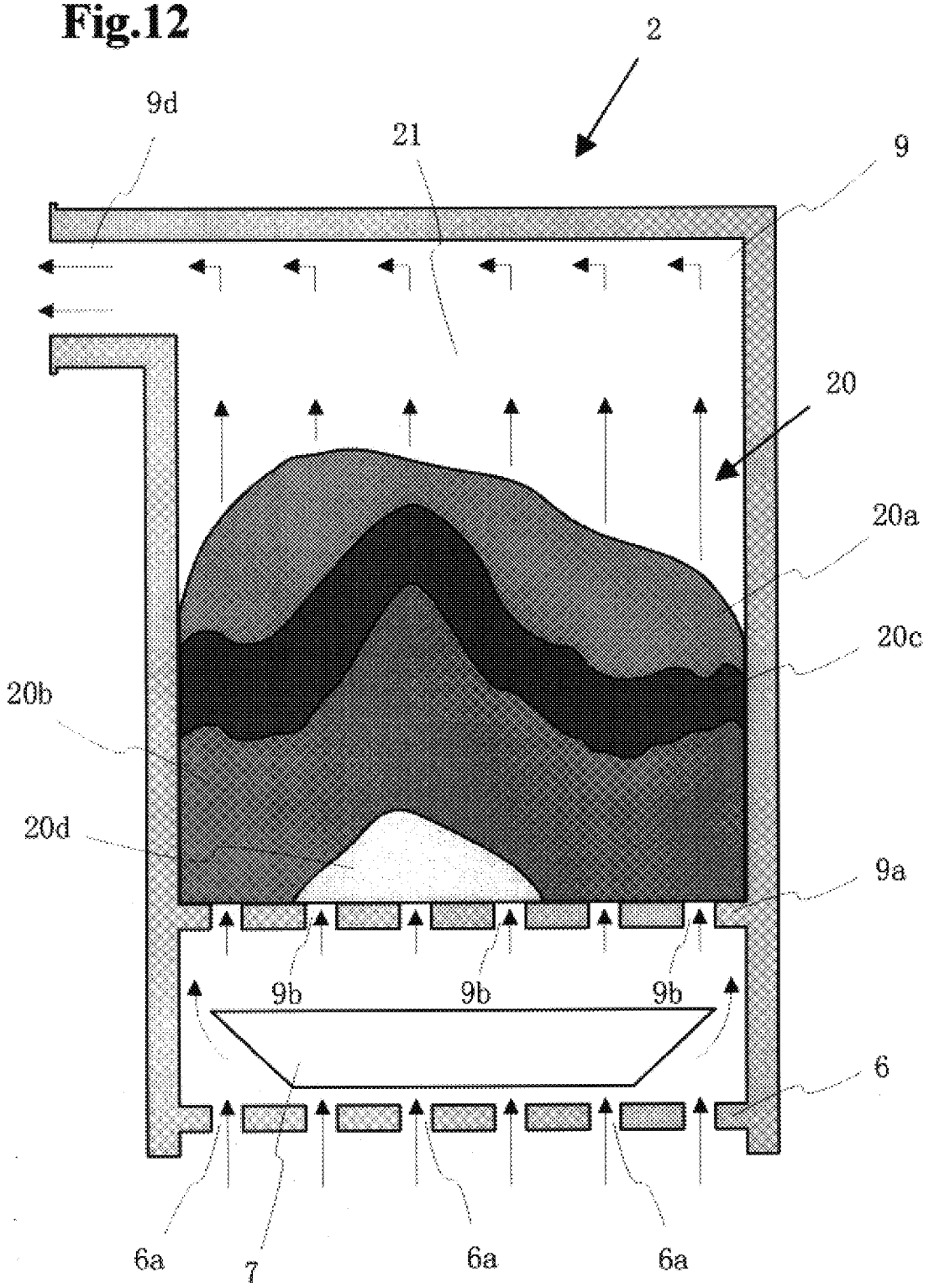
FIG. 12 is a view showing another burning condition of incineration substances in the burning section of the incinerator for removing toxic substances according to the present invention.

Further, as illustrated in FIG. 12, when the incineration substances are burnt in the oxidizing and burning section 20*b*, then a white incineration ash section 20*d* is formed in the oxidizing and burning section 20*b*. The incineration ashes 20*d* are accumulated on the ash receiving dish 7 installed in the ash chamber 8 from the through holes 9*b*.

Figure 13:
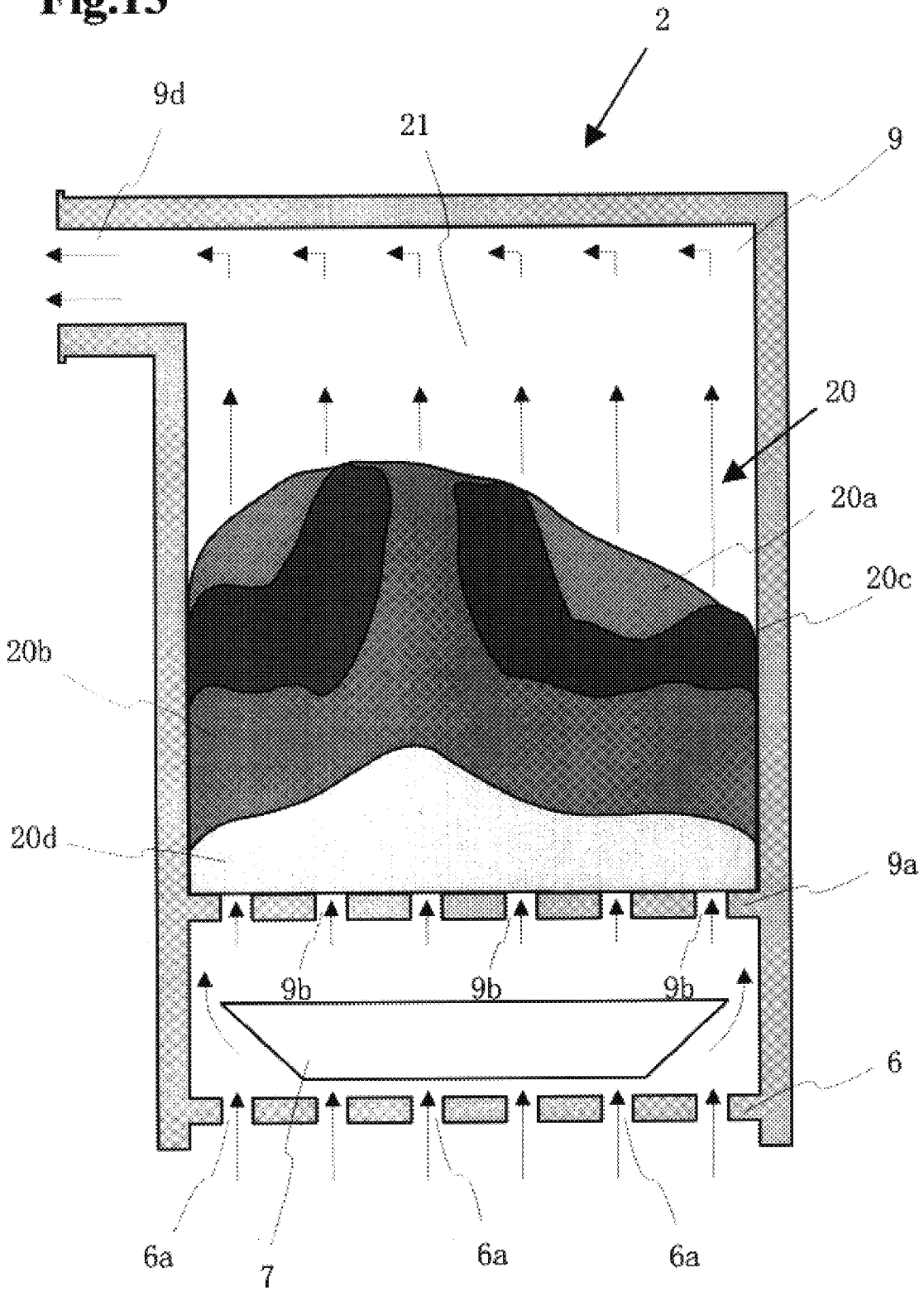
FIG. 13 is a view showing another burning condition of incineration substances in the burning section of the incinerator for removing the toxic substances according to the present invention.

Then, as illustrated in FIG. 13, as the burning of the incineration substances 20 proceeds, the oxidizing and burning section 20*b* will rise to break through a part of unburnt section 20*a* and fumigating and burning section 20*c*. At this time, on viewing from the upper part of the incineration substances 20, the oxidizing and burning section 20*b* can be seen. That is to say, as shown in FIG. 13, the oxidizing and burning section 20*b* and the fumigating and burning section 20*c* are gradually reducing the unburnt section 20*a* of the incineration substances 20, then the incineration ash section 20*d* is gradually enlarged from the lower part of the incineration substances 20.

Figure 14:
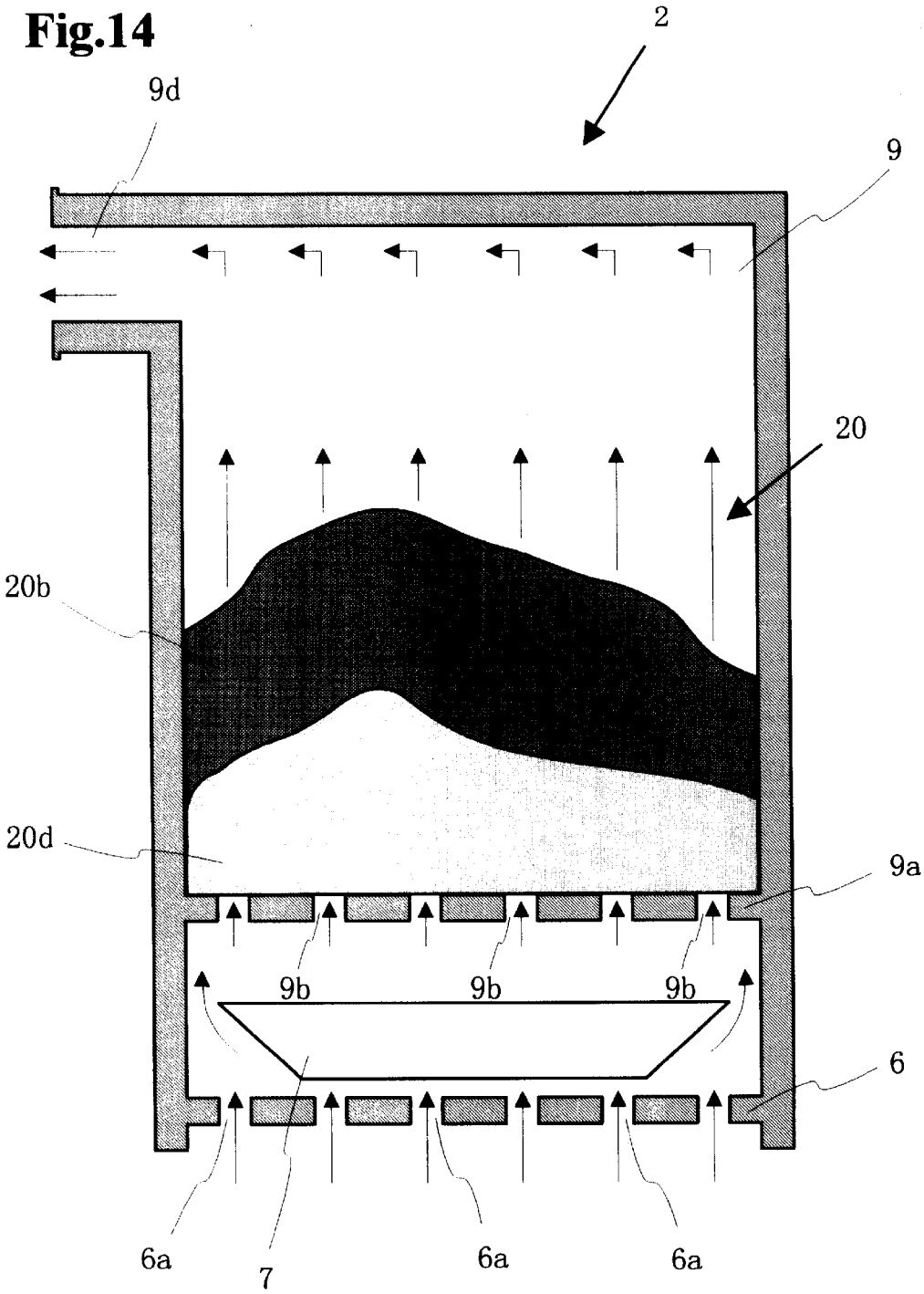
FIG. 14 is a view showing another burning condition of incineration substances in the burning section of the incinerator for removing toxic substances according to the present invention.

As a result, as shown in FIG. 14, the unburnt section 20*a* and fumigating and burning section 20*c* are gradually completely combusted. The reducing atmosphere decreases, and the oxidizing and burning section 20*b* is in the majority. In such circumstances, the incineration substances 20 become almost completely combusted, and on viewing from the upper part of the incineration substances 20, the entire substances are red-hot and burning, to generate heat.

Figure 15:
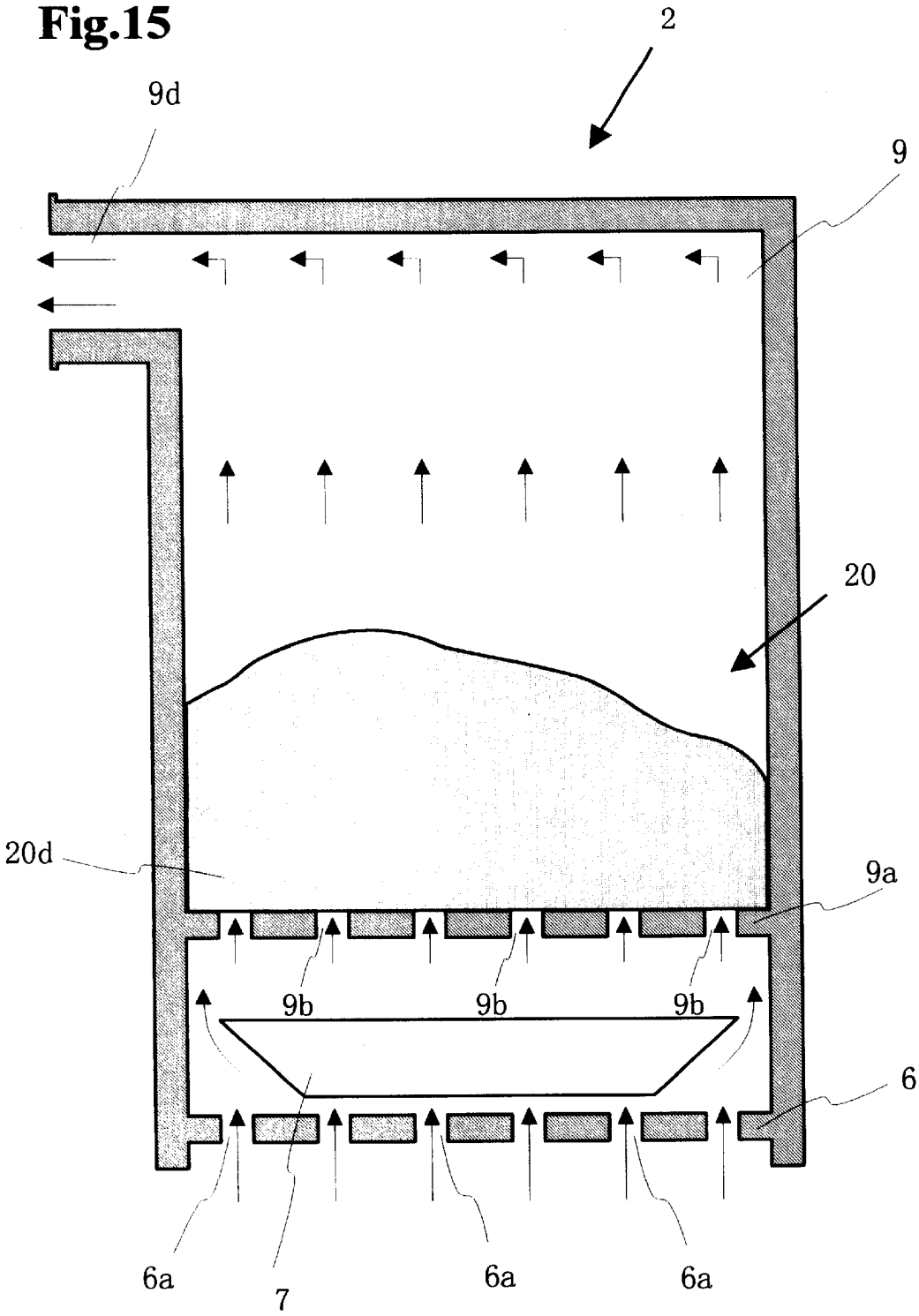
FIG. 15 is a view showing another burning condition of incineration substances in the burning section of the incinerator for removing toxic substances according to the present invention.

As illustrated in FIG. 15, when the incineration substances 20 are perfectly burnt, the incineration substances 20 reduce completely to white ashes, and the incineration ash section 20*d* is formed. Further, the ashes drop from the through holes 9*b* into the ash receiving dish in the ash chamber 8.

Generally, to completely burn incineration substances without generating toxic substances, it is necessary to burn the substances at a temperature of about 800° or more, and to perfectly burn the object without any cinder remaining.

The incinerators 1 for removing toxic substances according to the present invention can achieve complete combustion by the use of negative pressure combustion under negative pressure conditions in the primary combustion chamber 9 and to absorb the air due to the ejector effect to burn the incineration substances 20 thoroughly as illustrated in FIG. 8 and FIG. 9, and by the method of semi-carbonization burning to simultaneously cause burning and fumigating in the burning process of the burning section.

The toxic substances are reburnt at a high temperature with the incinerators 1, and the unburnt gas, unburnt carbon, odorant, dioxin, etc. contained in the reducing atmosphere are pyrolyzed and discharged to the atmosphere as a completely untoxic or harmless exhaust gas.

Figure 16:
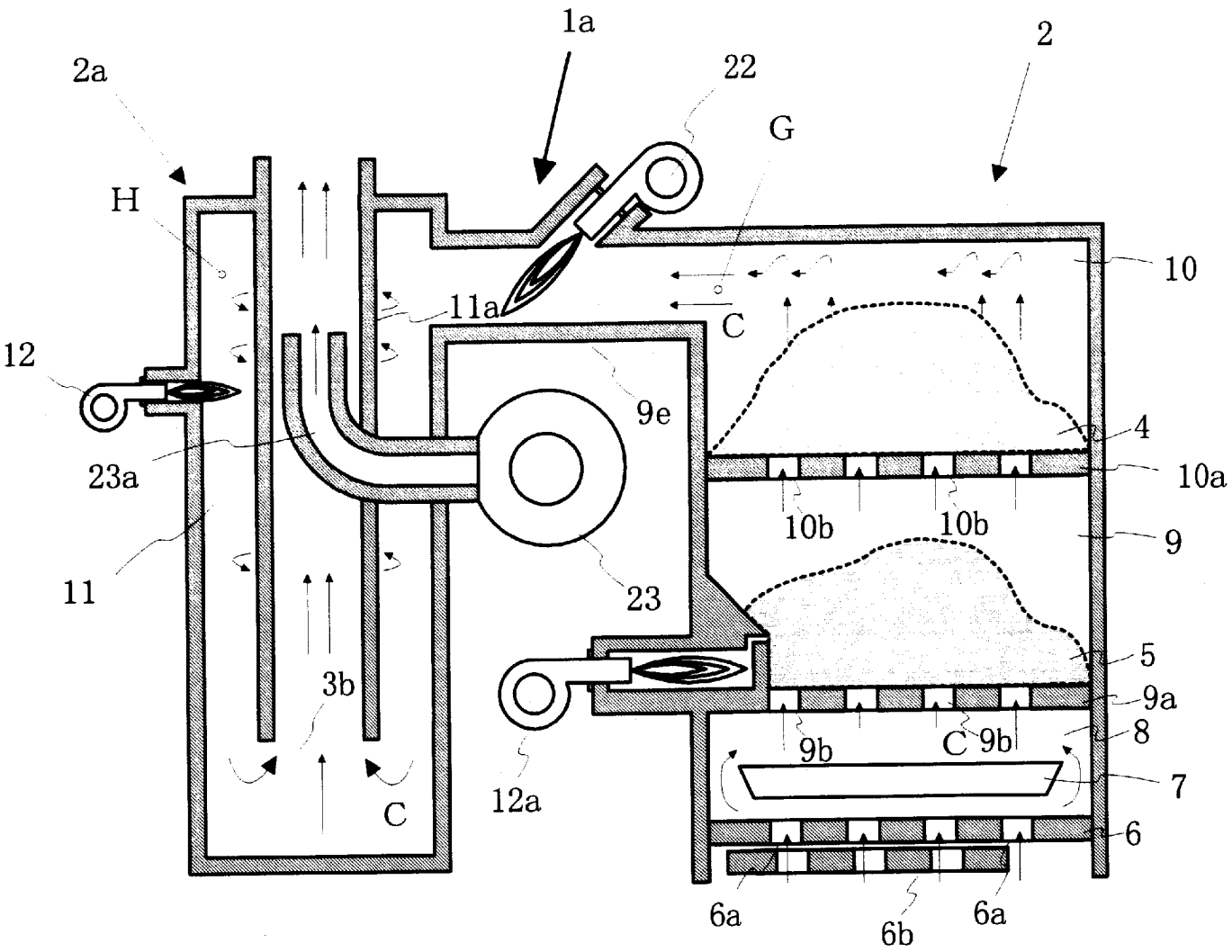
FIG. 16 is a longitudinal sectional view showing an incinerator for removing toxic substances according to the fourth embodiment of the present invention.

FIG. 16 is a longitudinal sectional view showing an incinerator for removing toxic substances according to the fourth embodiment of the present invention.

The incinerator according to this embodiment, uses an air duct type negative pressure condition in the burning section 2 and the removal section 2*a*, by blowing forcibly from the blower 23 into the exhaust gas pipe 11*a*, and discharging the smoke forcibly from the exhaust gas pipe 11*a*.

The number 6*b* indicates an air control valve to control the air to be charged. The air control valve 6*b* is disposed under the incinerator's floor 6, and controls the quantity of air introduced by closing or opening the air intake holes 6*a* formed on the incinerator's floor 6 by movement of the air control valve 6*b*. In the incinerator for removing the toxic substances illustrated in FIG. 1, FIG. 2 and FIG. 3 as well, the air control valve 6*b* may be installed.

Figure 17:
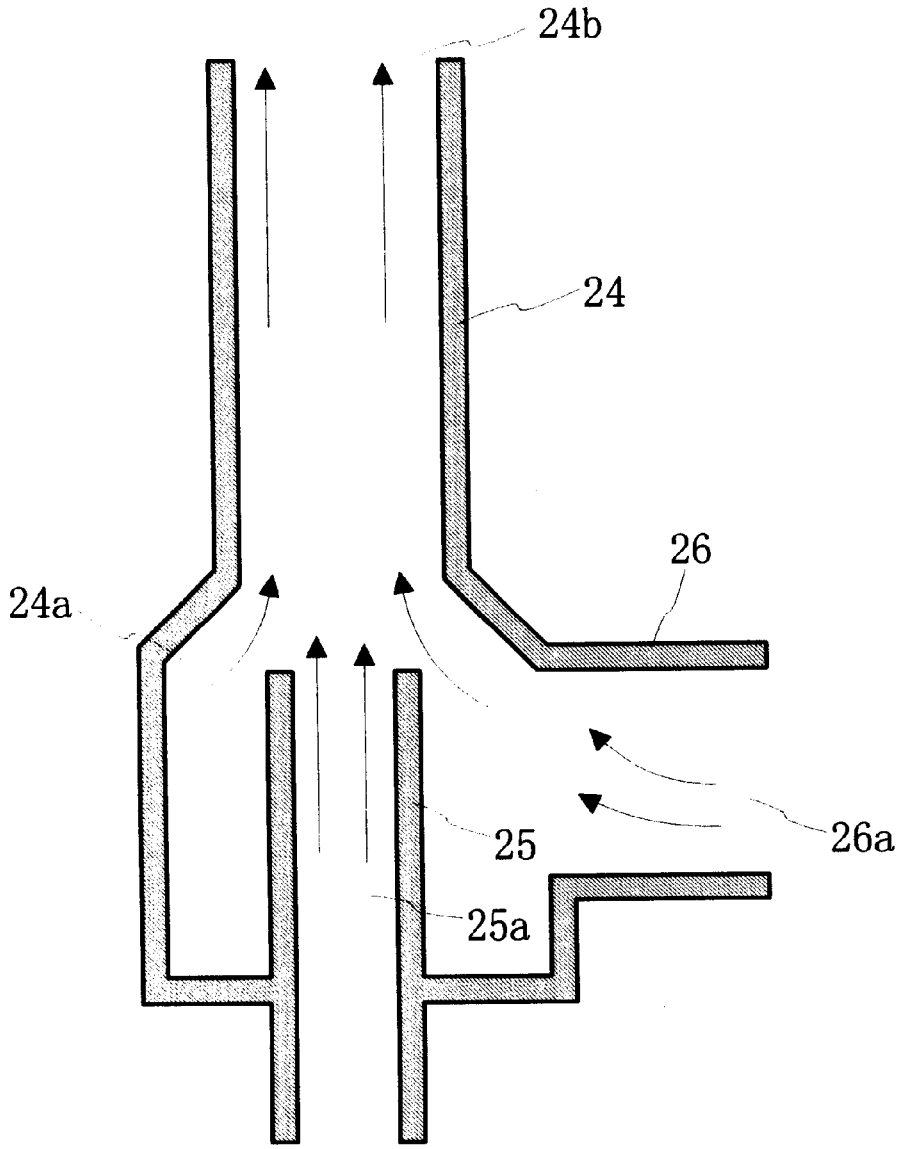
FIG. 17 is a longitudinal sectional view showing another structure of the air duct type negative pressure means of the incinerator for removing toxic substances according to the present invention.

FIG. 17 is a longitudinal sectional view showing a different air duct type negative pressure means (blower type negative pressure means) of the incinerator for removing toxic substances according to the present invention. In this air duct type negative pressure means, 24 indicates an exhaust for a projection pipe 25 for charging air from the blower into the exhaust section 24*a*, while 26 is a connection for the burning section and the secondary combustion chamber.

In the air duct negative pressure means, the air changed from the blower on the inside section of projection pipe 25*a* of projection pipe 25 which connected to the blower is forcibly exhausted from the exhaust gas outlet 24*b* through the inside of exhaust section 24*a*. But, because the inside of the exhaust section is at a negative pressure condition, after the smoke generated from the burning in the burning section, secondary combustion changer, etc. was injected from the air intake inlet 26*a* of the connection section 26 into the exhaust section 24*a*, the smoke (exhaust gas) is forcibly discharged from the exhaust gas outlet 24*b* into the atmosphere.

In FIG. 1, FIG. 2, FIG. 3 and FIG. 16 showing the incinerator for removing the toxic substances according to the present invention, one removal section 2*a* is installed in line with the burning section 2, but two or more removal sections may be installed as a structure.

Figure 18:
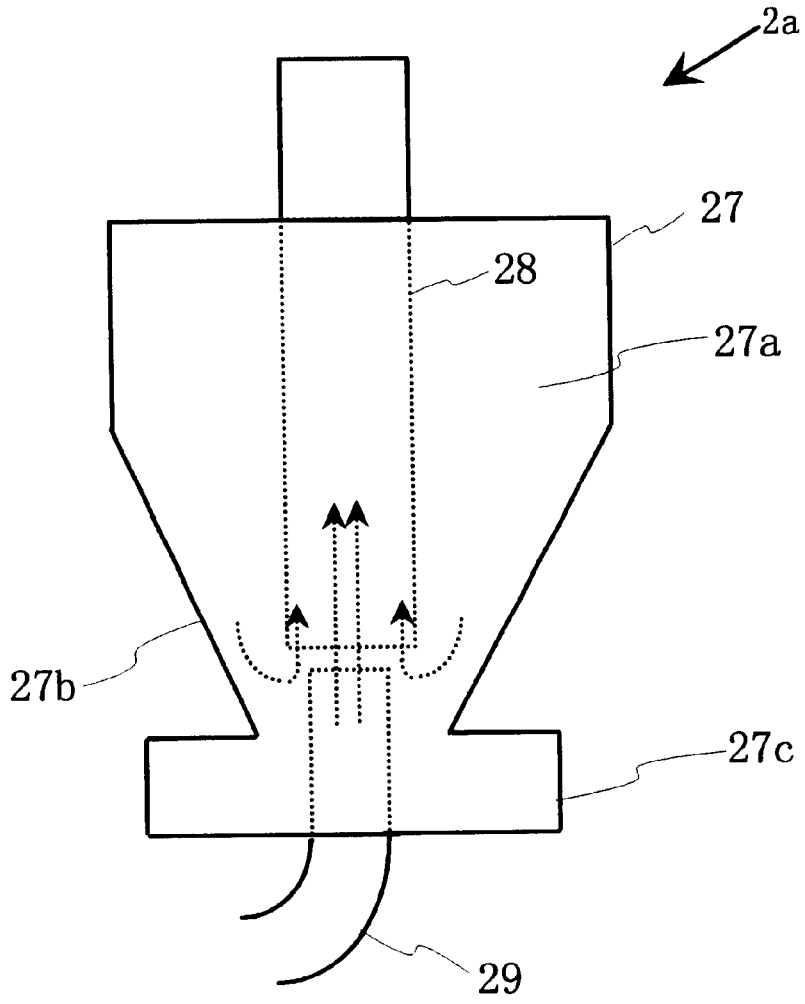
FIG. 18 is a view showing a cyclone collector installed, instead of the removal section in the incinerator, for removing toxic substances according to the present invention.

FIG. 18 is a view showing use of a cyclone instead of the removal section in the incinerator for removing the toxic substances according to the present invention. As illustrated in FIG. 18, the cyclone 27 is tapered in the lower part.

Instead of the removal section 2*a*, the cyclone 27 may be installed in line with the burning section 2. In the cyclone body 27*a*, the smoke (exhaust gas) generated from the inside of burning section 2 flows into the cyclone. The dust contained in the smoke charged to the cyclone 27 drops to the dust receiving dish 27*c*, thus smoke, with the dust removed, is exhausted through the exhaust gas pipe 28 into the atmosphere.

The smoke with the dust removed is discharged to the atmosphere, that is to say, the smoke with the dust removed in the cyclone 27*a*, is carried by air forcibly sent from the projection section of air duct 29 of the blower, and charged into the exhaust gas pipe 28, then exhausted into the atmosphere. When the smoke, with the dust removed, is forcibly discharged, the inside of the cyclone assumes a negative pressure and the incineration smoke in the burning section is absorbed into the inside of cyclone 27*a*. Therefore, the inside of the burning section assumes a negative pressure as well, and thus, the fresh air containing oxygen from the incinerator's floor 6 is induced into the burning section 2.

INDUSTRIAL APPLICABILITY

The present invention is of the structure as described above, therefore, the following effects result. Firstly, the control of the quantity of air in the primary combustion chamber causes the inside of the chamber to be under a reducing atmosphere, restricting the generation of carbon monoxide, dioxin and other toxic substances. The combustion of substances at a temperature of 800° C. or more in the oxidizing and burning section in the lower part, and at a temperature of 500° C. over 300° C. under the reducing atmosphere in the upper part enables the toxic substances to be completely pyrolyzed and to be completely removed.

Secondly, the heating of the substances in the primary combustion chamber and the incineration of the flue gas in the secondary combustion chamber enable the toxic substances contained in the flue gas to be pyrolyzed at a temperature of 800° or more, and also enable the efficient removal of smoke and odor.

Thirdly, the incineration of substances at a temperature of 800° C. or more using the suction type negative pressure means, air duct type negative pressure means, and the mixing of the flue gas (smoke) with the air sent by the above means and the incineration of the mixture makes the exhaust gas at a temperature of 300° C. or more, causing no generation of dioxin, etc.

What is claimed is:

1. An incinerator for removing toxic substances in which a removal section comprising a secondary combustion chamber equipped with a burner for removing the toxic substances generated from a burning section and a fan for absorbing and exhausting hot air in the secondary combustion chamber is connected to the burning section comprising a primary combustion chamber for burning incineration substances and an ash chamber having an ash receiving dish for receiving incineration ash generated from the incineration substances burnt in the primary combustion chamber, wherein a heating burner for heating the incineration substances is disposed in a first combustion chamber of the burning section, and a drying chamber is disposed on the primary combustion chamber.

2. The incinerator for removing the toxic substances according to claim 1, wherein one or more burners are disposed in the secondary combustion chamber of the removal section.

3. The incinerator for removing the toxic substances according to claim 2, wherein the rotational speed of the fan in the removal section is adjustable.

4. An incinerator for removing toxic substances in which a removal section comprising a secondary combustion chamber equipped with a burner for removing the toxic substances generated from a burning section and a fan for absorbing and exhausting hot air in the secondary combustion chamber is connected to the burning section comprising a primary combustion chamber for burning incineration substances and an ash chamber having an ash receiving dish for receiving incineration ash generated from the incineration substances burnt in the primary combustion chamber, wherein a drying chamber is deposited on the primary combustion chamber.

5. The incinerator for removing toxic substances according to claim 4, wherein one or more burners are disposed in the secondary combustion chamber of the removal section.

6. The incinerator for removing the toxic substances according to claim 5, wherein the rotational speed of the fan in the removal section is adjustable.

* * * * *